United States Patent [19]

Peterson

[11] Patent Number: 4,546,989

[45] Date of Patent: Oct. 15, 1985

[54] TOY ANIMAL VEHICLE

[76] Inventor: Arthur G. Peterson, 7818 Eden Ct., Eden Prairie, Minn. 55344

[21] Appl. No.: 593,508

[22] Filed: Mar. 26, 1984

[51] Int. Cl.[4] ..... A63F 19/00

[52] U.S. Cl. ..... 280/1.16; 280/1.206; 280/1.208

[58] Field of Search ..... 280/1.16, 1.11 R, 1.12, 280/1.13, 1.165, 1.188, 1.206, 1.208; 411/508, 509, 510, 182; 24/294, 573, 625

[56] References Cited

U.S. PATENT DOCUMENTS

| | | |
|---|---|---|
| 63,433 | 4/1867 | Scheen . |
| 202,056 | 4/1878 | Scharf . |
| 908,229 | 12/1908 | Fahrney . |
| 990,997 | 5/1911 | Magee . |
| 1,772,794 | 11/1928 | Arney . |
| 2,125,976 | 2/1936 | Young . |
| 3,628,801 | 4/1970 | Lambrecht . |

*Primary Examiner*—Joseph F. Peters, Jr.
*Assistant Examiner*—Donn McGiehan
*Attorney, Agent, or Firm*—Robert C. Baker

[57] ABSTRACT

A toy animal vehicle for riding by a child, having a mainframe structure with a seat supported by struts and a forward tongue member. A pair of rear wheels are mounted on an axle journaled in the struts. A substantially hollow contoured animal body of organic plastic material embraces at least the forward part of the tongue and has a transverse slot through its upper wall and an upwardly directed knob projecting from its upper wall. The steering mechanism has a steerable post in the forward end of the tongue, with a wheel in a forked member below the tongue member and a lateral crossbar member on the post above the tongue. Handlebars on the knob of the animal body, and a pair of laterally spaced connecting rods extending from the crossbar through the transverse slot to the handlebars accomplish positive steering.

7 Claims, 5 Drawing Figures

TOY ANIMAL VEHICLE

BACKGROUND OF THE INVENTION

This invention relates to a toy animal vehicle, especially one for riding by a child, and particularly relates to a toy animal vehicle wherein much of the steering mechanism is within the body of the animal and concealed by the body. The hand-operated steering control member is externally mounted onto the animal body itself as distinct from a mainframe structure of the vehicle. Nevertheless, no movement of any part of the animal body itself is required in order for a child riding the vehicle to steer it.

Toy vehicles of the general type to which the invention is directed, namely those having a seat member behind an animal body, have in all known instances employed reins or other flexible steering means, and thus have lacked both push and pull steering control. A further important distinction of the present invention over prior art teachings is that of the simplicity of the structural relationships taught herein, as well as the preferred unitary character of several main elements forming the structure of the present invention.

SUMMARY OF THE INVENTION

The new toy animal vehicle of the invention is of small size and designed for riding by a child. Its mainframe structure is preferably unitary and molded as a single piece. The mainframe structure consists essentially of a seat member, a pair of seat member supporting struts laterally spaced apart and extending downwardly of the seat member, and a tongue member extending forwardly of the seat member from a location medially between the struts.

An axle means is carried near the lower terminus of each strut and extends outwardly therefrom. Rear wheels are mounted on the axle means at a location outwardly of each strut.

An important structure of the vehicle is that of a substantially hollow contoured animal body. This animal body is preferably formed of organic plastics material. It embraces at least the forward part of the tongue member of the mainframe structure. It is united to the tongue member; and in this respect, the animal body is preferably formed of two parts of essentially mirror image character. One part forms the left half and the other the right half of the animal body.

Preferably the front limbs of the body depend below the tongue member in a laterally spaced relationship at a forward location approximately at the fore end of the tongue member of the mainframe structure; and the animal body essentially covers and conceals the fore end of the tongue member. Further, the rear limbs of the animal body depend below the tongue member in a spaced relationship at a rearward location foreward of but proximate to the seat member. The animal body is further characterized by having a transverse slot opening through its upper wall at a location more proximate to the rear end than the fore end of the body, as well as by having a generally upwardly directed knob projecting from its upper wall at a location rearwardly of the slot opening.

The vehicle includes foot-operated propulsion means comprising a pair of foot pedals mounted in suspended relationship from the tongue member at a location forwardly of the seat member. Connecting means are operative between the foot pedals and at least one of the rear wheels for transmitting force applied to the foot pedals to the one rear wheel so at to effect rotational movement of that rear wheel.

The steering means for the vehicle comprises a steerable post journaled in and extending through the forward end of the tongue member, with the post terminating at its lower end in a forked member below the tongue member and having at its upper end a lateral crossbar member above the tongue member. A front wheel is journaled in the forked member.

It is the knob of the animal body which carries and has mounted upon it a hand-operated pivotable steering control member such as a handlebar or the like. Between this steering control member and the crossbar of the steering post extend a pair of laterally spaced connecting rods. The connecting rods extend through the transverse slot of the animal body to the concealed crossbar on the steerable post. Thus steering movement of the steering control member is transmitted in a positive fashion through connecting rods to the front wheel of the vehicle for turning and steering the same.

Simplicity of structure is further obtained by employing frictional snap-fitted components, as will further be discussed hereinbelow.

In the most preferred embodiments of the invention, substantially all if not all components are formed of organic plastics material.

DESCRIPTION OF PREFERRED EMBODIMENT

Figure 1:
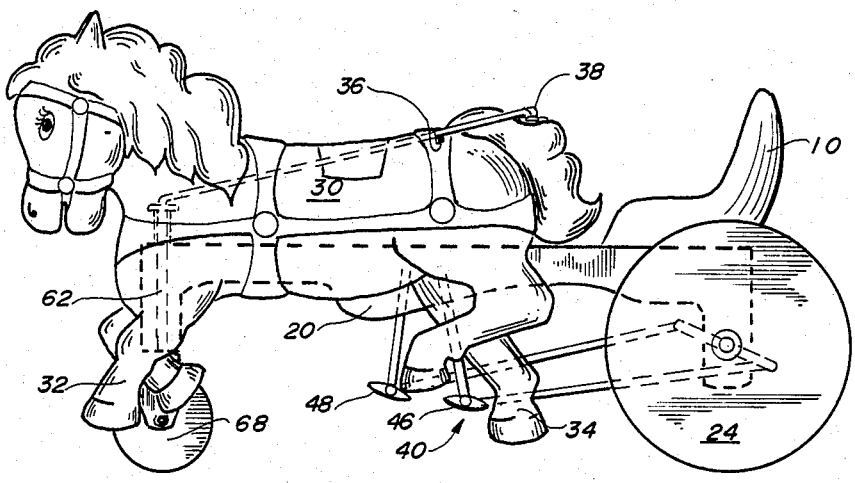
FIG. 1 is a schematic plan view of one side of the vehicle, namely the left side as considered by one riding the vehicle.
Figure 2:
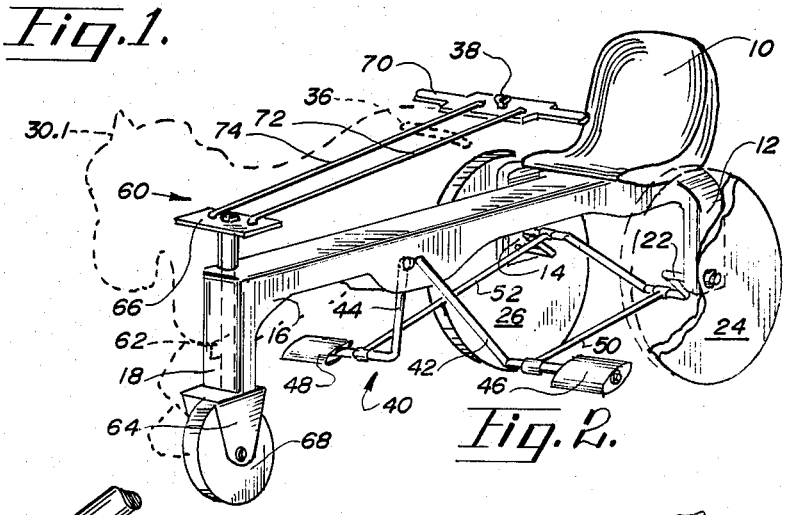
FIG. 2 is a schematic perspective view of the vehicle, with parts broken away and a portion of the right half of the animal body shown in broken lines.

Referring particularly to FIGS. 1 and 2, the mainframe structure of the vehicle will first be described. This structure consists essentially of a seat member 10, a pair of struts 12 and 14, and a tongue member 16. This mainframe structure is best formed of plastics material as a single unitary piece. The seat member 10 is preferably a contoured bucket seat. Struts 12 and 14 may be looked upon as the depending leg members of an inverted U-shaped continuous mass of plastic material. The tongue member preferably extends forward from the merging of the struts under the seat member and has a curved or build-up of mass 18 of plastic material extending downwardly at its forward end. Further, a buildup of mass 20 of plastics material is provided about midway of the length of the tongue for the purpose of providing a journal area for mounting propulsion means to be discussed.

Figure 4:
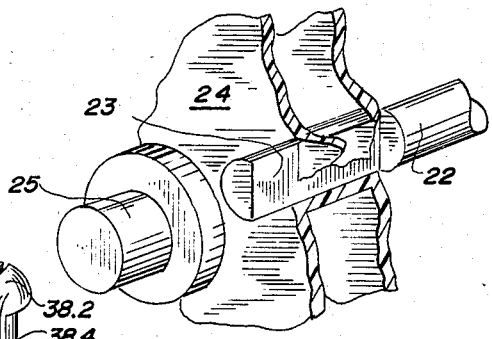
FIG. 4 is a schematic perspective view of a drive wheel on the rear axle of the vehicle, with parts broken away so as to permit greater clarity of illustration of the mounting.

The depending struts carry near their lower terminus an axle means 22 which extends outwardly of each strut and is journaled in the strut for rotary movement. Most preferably the axle means is a crank axle as illustrated. Rear wheels 24 and 26 are mounted on the axle means outwardly of each strut. To provide for disproportionate rotation of rear wheels as a corner is turned, it is preferred that only one of the rear wheels be mounted in a fixed manner on the axle so as to be turned by crank rotation of the axle; the other rear wheel, illustratively rear wheel 26, is mounted for free rotation on the axle means. A preferred and simple mounting of the rear wheel 24 in a fixed manner on the axle means so as to be rotated with the crank axle is illustrated in FIG. 4. As there shown, the end of the axle 22 that projects through the strut is provided with a flat surface by forming it into a half cylinder shape 23. The axle opening for wheel 24 is provided with a like half cylinder shape so that the mating of the half cylinders effectively keys or locks the wheel for rotation with the axle. Over the end of the axle is a snap-fitted friction-secured hubcap 25 having a top hat configuration. Once secured on the axle 22, the hubcap 25 is most difficult to remove and locks the wheel 24 on the axle 22.

The animal body 30 is a contoured body member and is substantially hollow. It is formed of organic plastics material. It embraces at least the forward part of the tongue member 16 and is united thereto, as by any suitable fastening means such as adhesive, screws, clamps, or the like. The front limbs 32 of the body 30 depend below the tongue member in laterally spaced relationship. Preferably, the animal body is formed in two parts having a mirror image relationship and with the line of separation between the two parts extending vertically along the longitudinal length, so that the two parts are a left half and a right half. These two mirror image parts are united together suitably by adhesive or other means, including clamping as will be discussed. Importantly, each half of the animal body is provided with both front limbs 32 and both rear limbs 34. Thus, both limbs at each end are viewable from the side of the body. Further, the inward or medial surface of the front limbs on each side of the vehicle is suitably formed so as to be substantially flat, although a slight contour on the medial or inward portion of the pair of front limbs on each side of the vehicle is not objectionable. The preferred location for the front limbs 32 is such that the animal body and its front limbs obscure much of the front steering assembly components. Stated another way, the front limbs of the body depend below the tongue member in laterally spaced relationship at a forward location approximately at the fore end of the tongue member; and this location is such that the fore limbs or legs of the animal body depend downwardly but in spaced relationship away from the forked member 64 as well as the wheel 68 of the steering assembly. The spaced relationship of the front limbs of the body thus allows complete freedom for steering action but gives the illusion at a side view, as illustrated in FIG. 1, that the front limbs are more dominant than the steerable wheel 68.

The rear limbs 34 of the animal body also depend below the tongue member in a spaced relationship; and the inward or medial surface of the pair of rear limbs on each side of the animal body may suitably be essentially flat or with a slight contour. The rear limbs are in spaced relationship at a rearward location forward of but proximate to the seat member.

A transverse slot opening 36 extends through the dorsal or upper wall of the animal body at a location more proximate to the rear end than the fore end of the body. A still further feature of the animal body is that it is provided with a generally upwardly directed knob 38 which projects from its upper wall at a medial location rearwardly of the slot opening 36, and at a rearward location on the body.

Propulsion of the vehicle is accomplished by foot-operated means generally indicated at 40. This propulsion means comprises depending arms 42 and 44 which at their upper ends are provided with a horizontal shaft journaled in the enlarged mass 20 of the tongue so that the arms 42 and 44 are movable in a pivot-like manner below that journaled shaft. Foot pedals 46 and 48 are mounted on outward horizontal shafts or extensions at the lower end of the arms 42 and 44. Drive connecting rods 50 and 52 extend from the shafts carrying the foot pedals, preferably from a medial location with respect to the foot pedals, back to the crank elements of the crankshaft 22. Thus alternate pushing of the foot pedals effectively rotates the crankshaft 22 and transmits power for movement to the drive rear wheel 24.

The steering system generally indicated at 60 in FIG. 2 comprises a steerable post 62, a forked member 64 carrying a front wheel 68, a crossbar or plate 66, a hand-operated pivotable steering control 70, and steer connecting rods 72 and 74. The steerable post 62 extends through and is journaled in the forward end of the tongue member where the mass 18 curves downwardly. This post terminates in the forked member 64 as its lower end below the mass of the tongue member; and the upper end of the fork member 64 abuts and rides on the bottom of the mass 18 of the tongue.

Figure 3:
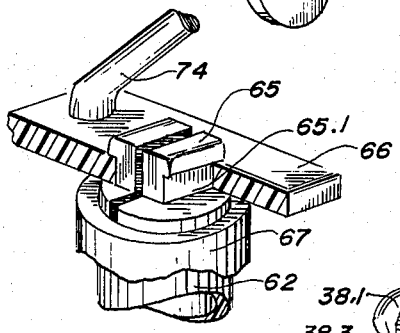
FIG. 3 is a schematic perspective view of the upper end of the steering post, with parts broken away.

Above the tongue member, as particularly illustrated in FIG. 3, the steerable post 62 terminates in a structure which may be characterized as a knob 65 having a square-like or rectangular-like configuration and a vertical slit into it so as to permit temporary pinching of the two parts of it together. The structure of the knob 65 may be noted to be smaller in diameter than the cylindrical post 62, thus permitting easy insertion of the post 62 upwardly through a cylindrical opening of mating size in the forward end of the tongue member. A sleeve 67 then is suitably placed over the upper projection of the steering post 62 and abuts the upper surface of tongue 16 at its forward end. Snap fitted over the knob 65 is a crossbar 66 having an opening just sufficient to receive in friction passage the pinched bulging portions of the knob 65 and then lock itself to the knob 65 at the shaft portion 65.1 of that knob just below the bulging upper portion thereof. The opening in the crossbar or plate 66 is square and thus locks itself onto the knob 65 against pivot movement about that knob. Thus, when plate 66 is shifted in a horizontal plane in a pivot manner or rotary manner, it effectively pivots the entire steering post as well as the forked member 64 and wheel 68. It should be noted that fixing the crossbar to the post so as to lock the same together for common movement may be accomplished by non-cylindrical or non-circular mating surfaces at the knob 65 and the opening of the crossbar.

Figure 5:
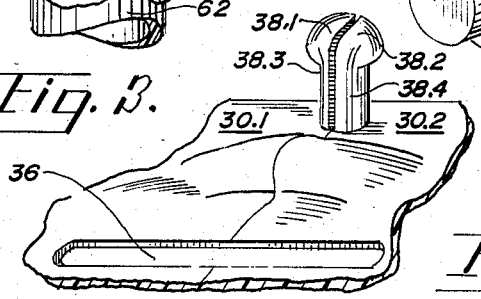
FIG. 5 is a schematic perspective view of a portion of the animal body, particularly illustrating the knob features for mounting the steering control member, and having parts broken away.

The mounting of the steering control member or handlebar 70 at the body knob 38 has similarities to, but is quite distinct from, the mounting of the crossbar 66 at the post knob 65. The steering control member 70 is provided with a circular or cylindrical opening which fits over the generally cylindrical shaft of the knob 38. Referring particularly to FIG. 5, the knob 38 is actually formed in two parts 38.1 and 38.2, as is the animal body. The two halves of the animal body are labeled 30.1 and 30.2 in FIG. 5. When the two halves of the animal body are brought together, the two parts 38.1 and 38.2 of the knob 38 are in a slightly spaced relationship. They are contoured so that the uppermost portion of the two parts 38.1 and 38.2 forming the knob 38, while slightly bulging as compared to the lower shaft portion 38.3 and 38.4 adjacent the upper surface of the animal body, can be brought together when the steering control member is press fitted over the knob 38 and pressed downwardly to a location just below the uppermost bulging portions 38.1 and 38.2. In this respect, it should be noted that the bulges 38.1 and 38.2 are in a direction transverse to the slit between them, with little or no bulge at the ends of the slit. The arrangement permits pivot shifting or rotation of the steering control member 70 about the axis formed by rigid knob 38. The pivot shifting of the handlebar or steering control 70 is transmitted through the laterally spaced steer rods 72 and 74 to the crossbar 66 of the steering means. The ends of each steering connecting rod 72 and 74 are mounted for pivot movement at their locations in the steering control member 70 and the crossbar 66.

The two halves of the animal body, molded so that their medial surfaces mate together along a vertical plane or mate to the tongue member, are mounted firmly to the tongue member; and this may be accomplished by use of screws as well as by adhesive, as desired.

Importantly, the spacing of the depending front legs of the animal body on each side of the tongue member is sufficient to permit lenient pivot movement in steering for the steerable front wheel 68 located between them. The spacing of the rear limbs or legs of the animal body on each side of the tongue member is such as to place them in close proximity to the depending arms 42 and 44 of the foot-operated propulsion means, with the foot pedals 46 and 48 laterally outward from the rear legs. In this respect, it should be noted that the rearmost of the rear legs, which rearmost leg preferably depends downwardly to or below the level of the foot pedals, is at a location immediately rearward of the most rearward movement of the horizontal shafts carrying the foot pedals 46 and 48.

The entire vehicle is of relatively miniature size. Vehicles of approximately 50 cm. in height (about 18 inches) from ground level to the upper surface of the head of the horse-like animal body are most preferred. Rear wheels of about 25 cm. in diameter (10 inches) are useful for such small vehicles; and a front wheel of approximately 10 cm. diameter (4 inches) can perform satisfactorily as a steerable wheel. These sizes, however, are intended as illustrative, but preferred.

Ideally, organic plastics components are employed in fabricating all elements of the vehicle, and are preferably employed at least in the fabricating of the entire mainframe as well as the animal body and the wheels. Even the components forming the steering assembly as well as the components forming the foot-operated propulsion means, including the axle, are preferably formed of organic plastics components, although metal components may optionally be employed for the crank axle and connecting rods and even other small elements, if desired. Suitable organic plastics materials to employ in fabricating the vehicle are polystyrene, polyamids such as nylon, polycarbonates, acrylates, or any other organic plastic either inherently having the strength characteristics or having capability of being bodied and massed to possess the necessary strength characteristics for the various components forming the vehicle.

Thus has been described a new type of toy animal vehicle wherein the body of the animal carries a positively acting steering control which shifts the steerable wheel by exerting both pushing and pulling forces through the steering mechanisms for that wheel, and a vehicle having a minimal number of required parts for assembly and great simplicity of assembly.

The invention may be embodied in still other specific forms than that specifically described without departing from the spirit and essential characteristics thereof. The illustrated embodiment is therefore to be considered in all respects as illustrative and not restrictive, the scope of the invention being indicated by the appended claims rather than by special detail of the foregoing descriptions; and all changes which come within the meaning and range of equivalency for the claims as properly construed for validity are therefore intended to be embraced thereby.

That which is claimed is:

1. A toy animal vehicle for riding by a child, comprising:

a mainframe structure consisting essentially of a seat member, a pair of seat member supporting struts laterally spaced apart and extending downwardly of the seat member, a tongue member extending forwardly of the seat member from a location medially between the struts, axle means carried near the lower terminus of each strut and extending outwardly therefrom, a rear wheel mounted on the axle means outwardly of each strut, a substantially hollow contoured animal body of organic plastics material embracing at least the forward part of the tongue member and united thereto, with the front limbs of the body depending below the tongue member in laterally spaced relationship at a forward location approximately at the fore end of the tongue member, and with the rear limbs of the body depending below the tongue member in a spaced relationship at a rearward location forward of but proximate to the seat member, the animal body being further characterized by having a transverse slot opening through its upper wall at a location more proximate to the rear end than the fore end of the body, and by having a generally upwardly directed knob projecting from its upper wall at a location rearwardly of the slot opening, foot-operated propulsion means comprising a pair of foot pedals mounted in suspended relationship from the tongue member at a location forwardly of the seat member, and connecting means operative between the foot pedals and at least one of the rear wheels for transmitting force applied to the foot pedals to effect rotation of the one rear wheel, and means for steering the vehicle comprising a steerable post journaled in and extending through the forward end of the tongue member, with the post terminating at its lower end in a forked member below the tongue member, a lateral crossbar member mounted on the post above the tongue member, a front wheel journaled in the forked member, a hand-operated pivotable steering control member mounted on the knob of the animal body, and a pair of laterally spaced connecting rods extending from the crossbar of the steering post through the transverse slot of the animal body to the steering control member, whereby steering movement of the steering control member is transmitted positively by both pushing and pulling moments of force to the front wheel for turning the same.

2. The vehicle of claim 1 wherein the animal body consists essentially of two parts forming left and right halves of the body, with each part having a half of the knob of said body, and wherein the steering control member includes a mounting hole within which the two halves of the knob are clamped together.

3. The vehicle of claim 1 wherein said axle means comprises a crank axle and said foot pedals are pivotally mounted with a connecting rod extending from each foot pedal medially of the legs of the animal body to the crank axle.

4. The vehicle of claim 1 wherein the seat member comprises a contoured bucket seat.

5. The vehicle of claim 1 wherein the entire mainframe structure and the wheels are formed of plastics material.

6. The vehicle of claim 1 wherein the upper end of the steerable post is non-circular in cross-section and is transversely slit in a plane passing through the axis of the post, and wherein the crossbar member of the steerable post is friction-snapped over said upper end.

7. A toy animal vehicle for riding by a child, comprising a mainframe structure having a seat and a forward tongue member, a pair of rear wheels supporting the seat, a substantially hollow contoured animal body of organic plastics material embracing at least the forward part of the tongue member and having a transverse slot through its upper wall and an upwardly directed knob projecting from its upper wall, and means for steering the vehicle comprising a steerable post in the forward end of the tongue member, with a steerable front wheel below the tongue member and a lateral crossbar member on the post above the tongue member, a steering control member on the knob of the animal body, and connecting means extending from the crossbar member through the transverse slot to the steering control member.

* * * * *